US008899056B2

(12) United States Patent
Kawano et al.

(10) Patent No.: US 8,899,056 B2
(45) Date of Patent: Dec. 2, 2014

(54) AIR CONDITIONER

(75) Inventors: Satoshi Kawano, Sakai (JP); Masahiro Oka, Sakai (JP); Kazuhiko Tani, Sakai (JP); Atsushi Okamoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1409 days.

(21) Appl. No.: 12/601,666

(22) PCT Filed: May 29, 2008

(86) PCT No.: PCT/JP2008/059889

§ 371 (c)(1),
(2), (4) Date: Nov. 24, 2009

(87) PCT Pub. No.: WO2008/149767

PCT Pub. Date: Dec. 11, 2008

(65) Prior Publication Data

US 2010/0293975 A1 Nov. 25, 2010

(30) Foreign Application Priority Data

May 30, 2007 (JP) ..... 2007-143814

(51) Int. Cl.
*F25B 45/00* (2006.01)
*F25B 13/00* (2006.01)
*F25B 49/00* (2006.01)

(52) U.S. Cl.
CPC ..... *F25B 45/00* (2013.01); *F25B 2700/21174* (2013.01); *F25B 2313/006* (2013.01); *F25B 49/005* (2013.01); *F25B 13/00* (2013.01); *F25B 2700/04* (2013.01); *F25B 2700/21163* (2013.01); *F25B 2313/02741* (2013.01)
USPC ..... 62/149; 62/174; 62/292; 62/503

(58) Field of Classification Search
USPC ..... 62/77, 149, 174, 292, 503
See application file for complete search history.

(56) References Cited

U.S. PATENT DOCUMENTS 5,187,942 A * 2/1993 Komatsu et al. ..... 62/149
5,224,354 A * 7/1993 Ito et al. ..... 62/210

(Continued)

FOREIGN PATENT DOCUMENTS

EP 1818627 A1 * 8/2007 ..... F25B 9/00
JP 59-175961 U 11/1984

(Continued)

OTHER PUBLICATIONS

JP2004294022A_Machine Translation.*
Office Action of corresponding Chinese Application No. 200880018056.2 dated Sep. 9, 2010.

*Primary Examiner* — Marc Norman
*Assistant Examiner* — Paolo Gonzalez
(74) *Attorney, Agent, or Firm* — Global IP Counselors

(57) ABSTRACT

An air conditioner includes a compressor, first and second heat exchangers connected with high pressure piping, low pressure piping connecting the second heat exchanger to a compressor suction port, a pressure reducing mechanism arranged to reduce pressure in the high pressure piping, a bypass passageway, a vessel connected to the bypass passageway, and first and second opening/closing mechanisms. The first heat exchanger is connected to a compressor discharge port. The bypass passageway is arranged to divert refrigerant from the high pressure piping to the low pressure piping without passing through the second heat exchanger. The first opening/closing mechanism is arranged to open/close a first portion of the bypass passageway that connects the high pressure piping to the vessel. The second opening/closing mechanism is arranged to open/close a second portion of the bypass passageway that connects an upper part of the vessel to the low pressure piping.

12 Claims, 4 Drawing Sheets

(56) References Cited

U.S. PATENT DOCUMENTS

| | | | | |
|---|---|---|---|---|
| 6,032,473 | A * | 3/2000 | Morimoto et al. | 62/205 |
| 6,209,338 | B1 * | 4/2001 | Thatcher, Jr. | 62/292 |
| 6,247,320 | B1 * | 6/2001 | Sumida et al. | 62/114 |
| 6,845,626 | B2 * | 1/2005 | Matsuoka et al. | 62/149 |
| 7,010,927 | B2 * | 3/2006 | Lifson et al. | 62/149 |
| 2003/0172665 | A1 | 9/2003 | Matsuoka et al. | |
| 2005/0229612 | A1 * | 10/2005 | Hrejsa et al. | 62/149 |
| 2005/0252221 | A1 * | 11/2005 | Mizutani et al. | 62/149 |
| 2006/0021362 | A1 * | 2/2006 | Sadegh et al. | 62/129 |
| 2009/0094998 | A1 * | 4/2009 | McSweeney et al. | 62/129 |

FOREIGN PATENT DOCUMENTS

| | | | | |
|---|---|---|---|---|
| JP | 07-218008 | A | 8/1995 | |
| JP | 08-100957 | A | 4/1996 | |
| JP | 11-108511 | A | 4/1999 | |
| JP | 2000-292037 | A | 10/2000 | |
| JP | 2000-304388 | A | 11/2000 | |
| JP | 2002-350014 | A | 12/2002 | |
| JP | 2002-372346 | A | 12/2002 | |
| JP | 2004294022 | A * | 10/2004 | F25B 1/00 |
| JP | 2006-292212 | A | 10/2006 | |
| JP | 2006-292213 | A | 10/2006 | |

* cited by examiner

AIR CONDITIONER

CROSS-REFERENCE TO RELATED APPLICATIONS

This U.S. National stage application claims priority under 35 U.S.C. §119(a) to Japanese Patent Application No. 2007-143814, filed in Japan on May 30, 2007, the entire contents of which are hereby incorporated herein by reference.

TECHNICAL FIELD

The present invention relates to an air conditioner that can determine whether a refrigerant circuit is filled with the appropriate amount of refrigerant.

BACKGROUND ART

In the conventional art, an air conditioner that comprises a heat source unit, a utilization unit, and a connection piping, which connects the heat source unit and the utilization unit, is known. When this air conditioner is constructed, a procedure is performed onsite wherein a refrigerant circuit of the air conditioner is filled with a refrigerant.

Nevertheless, if the refrigerant circuit is filled with an amount of refrigerant that is not appropriate, then there is a risk that the functions of the air conditioner will decline. Consequently, there is a need to determine whether the refrigerant circuit is filled with an appropriate amount of refrigerant.

Accordingly, among air conditioners that comprise a receiver, the interior of which can pool the refrigerant inside the refrigerant circuit, there exists an air conditioner that is provided with a liquid surface detecting means, which detects the liquid surface of the refrigerant pooled inside the receiver. With regard to this air conditioner, a refrigerant amount determining operation that determines the amount of refrigerant that has been filled in the refrigerant circuit by performing control that maintains the liquid surface inside the receiver at a constant level has been proposed (refer to Japanese Patent Application Publication No. 2006-292212).

SUMMARY OF THE INVENTION

Technical Problem

Nevertheless, in an air conditioner that does not comprise the receiver, it is difficult to determine whether the refrigerant circuit is filled with the appropriate amount of refrigerant. In addition, even in an air conditioner that does comprise the receiver, if the air conditioner does not have a refrigerant amount determining operation function, it is still difficult to determine whether the refrigerant circuit is filled with the appropriate amount of refrigerant.

It is an object of the present invention to provide an air conditioner that can determine whether a refrigerant circuit is filled with the appropriate amount of refrigerant, even when a receiver is not provided.

Solution to Problem

An air conditioner according to a first aspect of the present invention comprises a compressor, a first heat exchanger, a high pressure piping, a second heat exchanger, a low pressure piping, a pressure reducing mechanism, a bypass passageway, a vessel, a first opening/closing mechanism, and a second opening/closing mechanism. The compressor compresses a refrigerant. The first heat exchanger is connected to a discharge port of the compressor and functions as a condenser. The high pressure piping extends from the first heat exchanger. The second heat exchanger is connected to the first heat exchanger via the high pressure piping and function as evaporators. The low pressure piping connects the second heat exchangers and the suction port of the compressor. The pressure reducing mechanism is provided to the high pressure piping. The bypass passageway diverts the refrigerant from the high pressure piping to the low pressure piping without passing through the second heat exchangers. The vessel is provided to the bypass passageway. The first opening/closing mechanism is provided to a first portion of the bypass passageway that connects the high pressure piping and the vessel. The second opening/closing mechanism is provided to a second portion of the bypass passageway that connects an upper part of the vessel and the low pressure piping.

In the air conditioner according to the first aspect of the present invention, the vessel, the first opening/closing mechanism, and the second opening/closing mechanism are provided to the bypass passageway. The vessel is capable of pooling the refrigerant. In addition, the first opening/closing mechanism is capable of blocking the refrigerant that flows from the high pressure piping into the vessel. Furthermore, the second opening/closing mechanism is capable of blocking the refrigerant that flows from the vessel to the low pressure piping. Consequently, a prescribed amount of the refrigerant can be pooled in the vessel by regulating the first opening/closing mechanism and the second opening/closing mechanism.

Thereby, it is possible to determine whether the refrigerant circuit is filled with the appropriate amount of refrigerant.

An air conditioner according to a second aspect of the present invention is the air conditioner according to the first aspect of the present invention, wherein the compressor, the first heat exchanger, the high pressure piping, the second heat exchangers, and the low pressure piping constitute a main refrigerant circuit. In addition, a piping whose diameter is smaller than that of the high pressure piping is used for the first portion and the second portion of the bypass passageway.

In the air conditioner according to a second aspect of the present invention, the diameters of the pipings of the first portion and the second portion of the bypass passageway are smaller than that of the high pressure piping. Consequently, it is possible to use an opening/closing mechanism wherein the first opening/closing mechanism and the second opening/closing mechanism provided to the bypass passageway are smaller than, for example, the case wherein the opening/closing mechanism is provided to the high pressure piping.

Thereby, in this air conditioner, it is possible to reduce the cost of the opening/closing mechanism.

An air conditioner according to a third aspect of the present invention is the air conditioner according to the second aspect of the present invention and further comprises a control unit, which controls an overfill determination. An overfill operation control comprises a first step, a second step, a third step, and a fourth step and controls the determination of whether the refrigerant is in an excessively filled state.

With the air conditioner according to a third aspect of the present invention, the control unit performs the first step, the second step, the third step, and the fourth step during the overfill determination control. In the first step, the control unit performs control that sets the first opening/closing mechanism and the second opening/closing mechanism to an open state. Accordingly, the refrigerant is recovered from the high pressure piping into the vessel. In the second step, the control unit performs control that detects that the liquid refrigerant has begun to flow from the vessel to the low pressure piping. In the third step, the control unit performs control that sets at least the second opening/closing mechanism to the closed state in accordance with the fact that the start of flow of the liquid refrigerant to the low pressure piping has been detected in the second step. In the fourth step, the control unit performs control that, after the detection of the start of flow of the liquid refrigerant to the low pressure piping in the second step, determines whether the amount of the refrigerant in the main refrigerant circuit is in the insufficient range or in the sufficient range. Thereby, in the fourth step, the control unit determines whether the main refrigerant circuit is overfilled with the refrigerant.

Thereby, it is possible to determine that the refrigerant circuit is overfilled with the refrigerant.

An air conditioner according to a fourth aspect of the present invention is the air conditioner according to the third aspect of the present invention, wherein the determination, in the fourth step, of whether the amount of the refrigerant in the main refrigerant circuit is in the insufficient range or the sufficient range is a determination of whether the refrigerant at an outlet of the first heat exchanger is in the vapor-liquid two-phase or the liquid phase.

In the air conditioner according to the fourth aspect of the present invention, the amount of refrigerant with which the main refrigerant circuit is filled is determined by the state of the refrigerant at the outlet of the first heat exchanger. Consequently, in this air conditioner, it is possible to easily determine whether the amount of refrigerant in the main refrigerant circuit is appropriate.

An air conditioner according to a fifth aspect of the present invention is the air conditioner according to the fourth aspect of the present invention and further comprises a first temperature sensor and a second temperature sensor. The first temperature sensor detects the temperature of the refrigerant on the upstream side of the pressure reducing mechanism. The second temperature sensor detects the temperature of the refrigerant on the downstream side of the pressure reducing mechanism. In addition, in the fourth step, the control unit determines whether the refrigerant at the outlet of the first heat exchanger is in the liquid phase or in the vapor-liquid two-phase state and, based on that determination, determines whether there is an overfilled state.

The air conditioner according to the fifth aspect of the present invention further comprises the first temperature sensor and the second temperature sensor. Consequently, it is possible to detect the temperature of the refrigerant on the upstream side and the downstream side of the pressure reducing mechanism. The control unit calculates the difference between the temperature detected by the first temperature sensor and the temperature detected by the second temperature sensor, and, if that difference is less than or equal to a first threshold value, then the control unit determines that the refrigerant at the outlet of the first heat exchanger is in the liquid phase. In addition, if that difference is greater than the first threshold value, then the control unit determines that the refrigerant at the outlet of the first heat exchanger is in the vapor-liquid two-phase state. If the refrigerant at the outlet of the first heat exchanger is in the liquid phase, then the control unit determines that the refrigerant is in an overfilled state; further, if the refrigerant at the outlet of the first heat exchanger is in the vapor-liquid two-phase state, then the control unit determines that the refrigerant is not in an overfilled state.

Thereby, it is possible to determine that the refrigerant circuit is overfilled with the refrigerant.

An air conditioner according to a sixth aspect of the present invention is the air conditioner according to the third aspect of the present invention, wherein the determination, in the fourth step, of whether the amount of the refrigerant in the main refrigerant circuit is in the insufficient region or the sufficient range is a determination of whether the degree of supercooling of the refrigerant at the outlet of the first heat exchanger is less than or equal to a second threshold value or greater than a second threshold value. Consequently, it is possible to determine the amount of refrigerant with which the main refrigerant circuit is filled based on the degree of supercooling on the outlet side of the first heat exchanger.

Thereby, it is possible to determine that the refrigerant circuit is overfilled with the refrigerant.

An air conditioner according to a seventh aspect of the present invention is the air conditioner according to the third through sixth aspects of the present invention, wherein the control unit monitors, in the second step, the difference between a discharge side refrigerant temperature of the compressor and a condensing temperature of the first heat exchanger. In addition, when the degree of descent per unit of time of the difference between the discharge side refrigerant temperature of the compressor and the condensing temperature of the first heat exchanger is greater than a third threshold value, the control unit determines that the liquid refrigerant has begun to flow from the vessel to the low pressure piping through the second portion of the bypass passageway. Consequently, it is possible to determine that the refrigerant is overflowing from the vessel.

An air conditioner according to an eighth aspect of the present invention is the air conditioner according to the first aspect of the present invention and further comprises a third opening/closing mechanism. The third opening/closing mechanism is provided to a third portion, which is separate from the second portion, of the bypass passageway. The third portion connects a lower part of the vessel and the low pressure piping and is provided with a bypass pressure reducing mechanism that has a pressure reducing function.

In the air conditioner according to the eighth aspect of the present invention, a third opening/closing mechanism is provided. In addition, a bypass pressure reducing mechanism is provided to the third portion, which is provided by the third opening/closing mechanism. Consequently, it is possible to depressurize the liquid refrigerant pooled in the vessel and guide to the low pressure piping.

Thereby, it is possible to regulate the amount of refrigerant flowing through the main refrigerant circuit.

An air conditioner according to a ninth aspect of the present invention is the air conditioner according to the eighth aspect of the present invention and further comprises a control unit, which performs refrigerant adjustment control in a normal operation. In addition, a main refrigerant circuit of this air conditioner comprises the compressor, the first heat exchanger, the high pressure piping, the second heat exchangers, and the low pressure piping. In the refrigerant adjustment control, when it is determined that an excessive amount of the refrigerant is flowing through the main refrigerant circuit, the control unit sets the first opening/closing mechanism and the second opening/closing mechanism to the open state and the third opening/closing mechanism to the closed state. In addition, when it is determined that an insufficient amount of the refrigerant is flowing through the main refrigerant circuit, the control unit sets the first opening/closing mechanism and the second opening/closing mechanism to the closed state and the third opening/closing mechanism to the open state.

The air conditioner according to the ninth aspect of the present invention further comprises a control unit, which performs refrigerant regulation control in the normal operation. When it is determined in the refrigerant adjustment control that an excessive amount of the refrigerant is flowing through the main refrigerant circuit, the control unit performs control such that the first opening/closing mechanism and the second opening/closing mechanism are set to the open state, the third opening/closing mechanism is set to the closed state, and a prescribed amount of the refrigerant is recovered in the vessel. In addition, when it is determined that an insufficient amount of the refrigerant is flowing through the main refrigerant circuit, the control unit sets the first opening/closing mechanism and the second opening/closing mechanism to the closed state, sets the third opening/closing mechanism to the open state, and discharges the refrigerant from the vessel to the low pressure piping. Consequently, it is possible to regulate the amount of refrigerant flowing through the main refrigerant circuit in accordance with the excess or insufficiency of the refrigerant flowing through the main refrigerant circuit.

Thereby, it is possible to stably maintain the functions of the air conditioner.

Advantageous Effects of Invention

With the air conditioner according to the first aspect of the present invention, it is possible to determine whether the refrigerant circuit is filled with the appropriate amount of refrigerant.

With the air conditioner according to the second aspect of the present invention, it is possible to reduce the cost of the opening/closing mechanisms.

With the air conditioner according to the third aspect of the present invention, it is possible to determine that the refrigerant circuit is overfilled with the refrigerant.

With the air conditioner according to the fourth aspect of the present invention, it is possible to easily determine whether the main refrigerant circuit is filled with the appropriate amount of refrigerant.

With the air conditioner according to the fifth aspect of the present invention, it is possible to determine that the refrigerant circuit is overfilled with the refrigerant.

With the air conditioner according to the sixth aspect of the present invention, it is possible to determine that the refrigerant circuit is overfilled with the refrigerant.

With the air conditioner according to the seventh aspect of the present invention, it is possible to determine that the refrigerant is overflowing from the vessel.

With the air conditioner according to the eighth aspect of the present invention, it is possible to regulate the amount of refrigerant flowing through the main refrigerant circuit.

With the air conditioner according to the ninth aspect of the present invention, it is possible to stably maintain the functions of the air conditioner.

DETAILED DESCRIPTION OF THE INVENTION

Configuration of Air Conditioner

Figure 1:
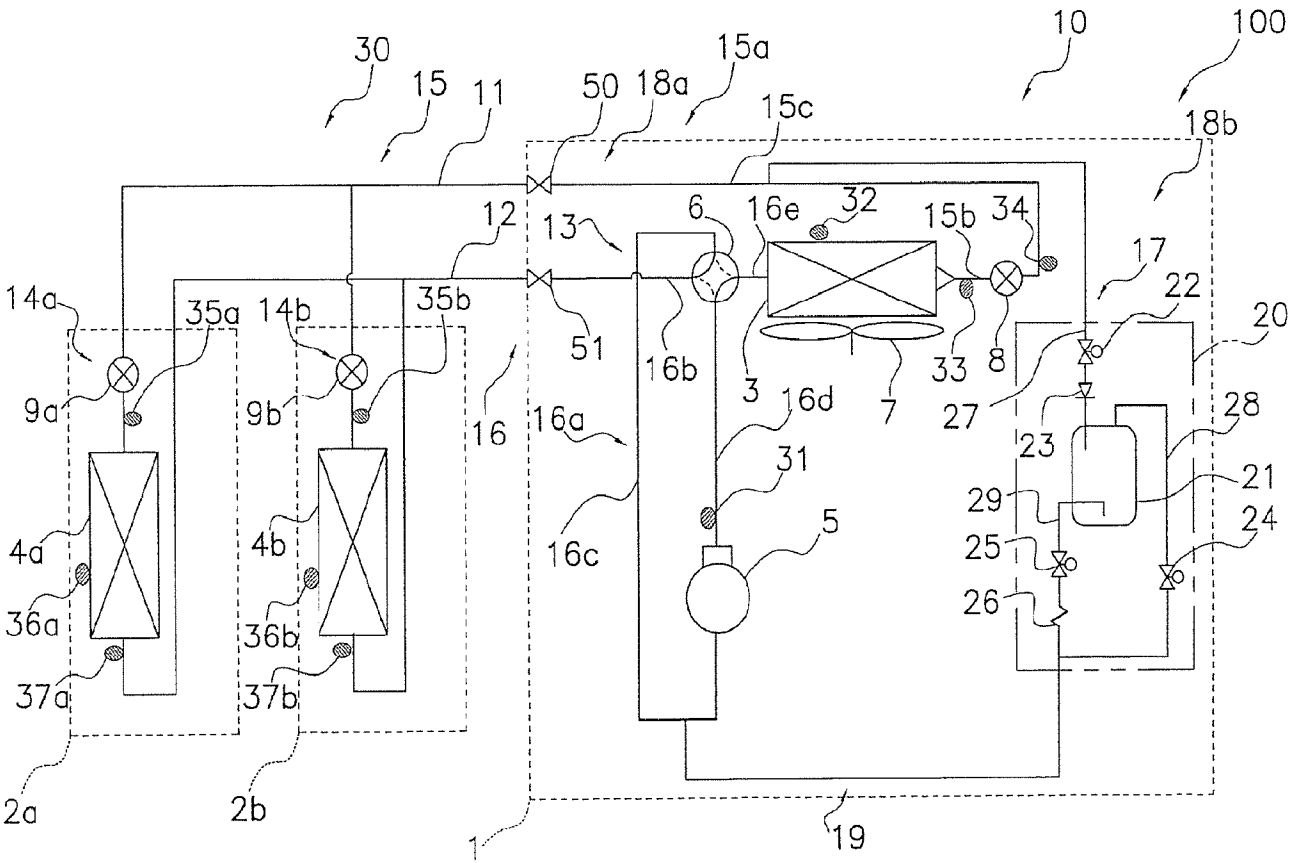
FIG. 1 is a schematic refrigerant circuit diagram of an air conditioner according to an embodiment of the present invention.

FIG. 1 schematically shows a refrigerant circuit 10 of an air conditioner 100 according to one embodiment of the present invention.

The air conditioner 100 principally comprises: an outdoor unit 1; two indoor units 2*a*, 2*b*, which are connected in parallel to the outdoor unit 1; and a liquid refrigerant connection piping 11 and a gas refrigerant connection piping 12, which serve as refrigerant connection pipings that connect the outdoor unit 1 with the indoor units 2*a*, 2*b*. Specifically, the liquid refrigerant connection piping 11 and the gas refrigerant connection piping 12 are connected to an outdoor side refrigerant piping 13 of the outdoor unit 1 and indoor side refrigerant pipings 14*a*, 14*b* of the indoor units 2*a*, 2*b*, respectively. Namely, the refrigerant circuit 10 of the air conditioner 100 is configured by connecting the outdoor side refrigerant piping 13, the indoor side refrigerant pipings 14*a*, 14*b*, the liquid refrigerant connection piping 11, and the gas refrigerant connection piping 12. In addition, the outdoor side refrigerant piping 13 comprises an outdoor side main refrigerant piping 18*a* and a bypass piping 18*b*. Furthermore, in the present embodiment, a circuit that is configured by connecting the indoor side refrigerant pipings 14*a*, 14*b*, the outdoor side main refrigerant piping 18*a*, the liquid refrigerant connection piping 11, and the gas refrigerant connection piping 12, each of which are part of the refrigerant circuit 10, is called the main refrigerant circuit 30. In addition, in the main refrigerant circuit 30, the piping wherethrough the refrigerant flows from a heat exchanger that functions as a condenser toward a heat exchanger that functions as an evaporator is called a liquid refrigerant piping 15, and a piping wherethrough the refrigerant flows from the heat exchanger that functions as an evaporator toward the heat exchanger that functions as a condenser is called a gas refrigerant piping 16. Below, in the various pieces of equipment that are provided to and disposed in the main refrigerant circuit 30 (discussed below), the side that is connected to the liquid refrigerant piping 15 is called the liquid side, and the side that is connected to the gas refrigerant piping 16 is called the gas side. In addition, the liquid refrigerant connection piping 11 is included in the liquid refrigerant piping 15, and the gas refrigerant connection piping 12 is included in the gas refrigerant piping 16.

(Indoor Unit)

The indoor units 2*a*, 2*b* are installed by, for example, embedding them in or suspending them from the indoor ceiling of a building or the like, or by attaching them to an indoor wall surface. As discussed above, the indoor units 2*a*, 2*b* comprise the indoor side refrigerant pipings 14*a*, 14*b*, which constitute part of the main refrigerant circuit 30. The indoor side refrigerant pipings 14*a*, 14*b* principally comprise indoor expansion valves 9*a*, 9*b* and indoor heat exchangers 4*a*, 4*b*, each of which is connected via a refrigerant piping, as shown in FIG. 1.

The indoor expansion valves 9*a*, 9*b* are motor operated expansion valves, which, to regulate the flow volume of the refrigerant that flows inside the indoor side refrigerant pipings 14*a*, 14*b*, are connected to the liquid sides of the indoor heat exchangers 4*a*, 4*b*.

The indoor heat exchangers 4*a*, 4*b* are cross fin type fin and tube heat exchangers, which comprise heat transfer pipes and numerous fins. In addition, the indoor heat exchangers 4*a*, 4*b* function as refrigerant evaporators during a cooling operation to cool the indoor air and function as refrigerant condensers during a heating operation to heat the indoor air.

In addition, the indoor units 2*a*, 2*b* are provided with indoor heat exchanger liquid side temperature sensors 35*a*, 35*b*, indoor heat exchanger gas side temperature sensors 37*a*, 37*b*, and indoor heat exchanger temperature sensors 36*a*, 36*b*. The indoor heat exchanger liquid side temperature sensors 35*a*, 35*b* are provided on the liquid sides of the indoor heat exchangers 4*a*, 4*b* and detect the temperature of the refrigerant in both the liquid state and the vapor-liquid two-phase state. The indoor heat exchanger gas side temperature sensors 37*a*, 37*b* are provided on the gas sides of the indoor heat exchangers 4*a*, 4*b* and detect the temperature of the refrigerant in both the gas state and the vapor-liquid two-phase state. In addition, the indoor heat exchanger temperature sensors 36*a*, 36*b* are provided to the indoor heat exchangers 4*a*, 4*b* and detect the temperature of the refrigerant that flows therein. In the present embodiment, the indoor heat exchanger liquid side temperature sensors 35*a*, 35*b*, the indoor heat exchanger gas side temperature sensors 37*a*, 37*b*, and the indoor heat exchanger temperature sensors 36*a*, 36*b* are composed of thermistors.

(Outdoor Unit)

The outdoor unit 1 is installed on, for example, the rooftop of a building and the like; furthermore, as discussed above, the outdoor unit 1 comprises the outdoor side main refrigerant piping 18*a* and the bypass piping 18*b*, which constitute part of the refrigerant circuit 10.

The outdoor side main refrigerant piping 18*a* principally comprises a compressor 5, a four-way switching valve 6, an outdoor heat exchanger 3, an outdoor expansion valve 8, a liquid side shutoff valve 50, and a gas side shutoff valve 51, each of which is connected via refrigerant pipings, as shown in FIG. 1. The outdoor side main refrigerant piping 18*a* comprises an outdoor side liquid refrigerant piping 15*a*, which is part of the liquid refrigerant piping 15, and an outdoor side gas refrigerant piping 16*a*, which is part of the gas refrigerant piping 16. The outdoor side liquid refrigerant piping 15*a* is the piping which connects the liquid side of the outdoor heat exchanger 3 and the liquid side shutoff valve 50 and comprises a first outdoor side liquid refrigerant piping 15*b* is the piping which and a second outdoor side liquid refrigerant piping 15*c* is the piping which. The first outdoor side liquid refrigerant piping 15*b* connects the liquid side of the outdoor heat exchanger 3 and the outdoor expansion valve 8. The second outdoor side liquid refrigerant piping 15*c* connects the outdoor expansion valve 8 and the liquid side shutoff valve 50. In addition, the outdoor side gas refrigerant piping 16*a* comprises a first outdoor side gas refrigerant piping 16*b* is the piping which, a second outdoor side gas refrigerant piping 16*c* is the piping which, a third outdoor side gas refrigerant piping 16*d* is the piping which, and a fourth outdoor side gas refrigerant piping 16*e* is the piping which and connects the gas side shutoff valve 51 and the gas side of the outdoor heat exchanger 3. The first outdoor side gas refrigerant piping 16*b* connects the gas side shutoff valve 51 and the four-way switching valve 6. The second outdoor side gas refrigerant piping 16*c* connects the four-way switching valve 6 and a suction side of the compressor 5. The third outdoor side gas refrigerant piping 16*d* connects a discharge side of the compressor 5 and the four-way switching valve 6. The fourth outdoor side gas refrigerant piping 16*e* connects the four-way switching valve 6 and the gas side of the outdoor heat exchanger 3.

As shown in FIG. 1, the bypass piping 18*b* comprises a refrigerant inflow piping 17, a refrigerant outflow piping 19, and a refrigerant adjustment unit 20. One end of the refrigerant inflow piping 17 is connected to the second outdoor side liquid refrigerant piping 15*c*, and the other end of the refrigerant inflow piping 17 is connected to a refrigerant adjustment vessel 21 of the refrigerant adjustment unit 20. In addition, one end of the refrigerant outflow piping 19 is connected to the refrigerant adjustment vessel 21, and the other end of the refrigerant outflow piping 19 is connected to the second outdoor side gas refrigerant piping 16*c*.

The compressor 5 is an apparatus that compresses the low pressure gas refrigerant sucked in from the suction side and discharges this pressurized high pressure gas refrigerant to the discharge side. In addition, the compressor 5 is capable of varying its operating capacity and is driven by a motor that is controlled by an inverter.

The four-way switching valve 6 is for switching the direction of the refrigerant's flow; during the cooling operation, refrigerant filling operation, and refrigerant amount determining operation, the four-way switching valve 6 connects the discharge side of the compressor 5 and the gas side of the outdoor heat exchanger 3, as well as the suction side of the compressor 5 and the gas refrigerant connection piping 12 (refer to the solid lines of the four-way switching valve 6 in FIG. 1). Accordingly, during the cooling operation, refrigerant filling operation, and refrigerant amount determining operation, the outdoor heat exchanger 3 functions as a condenser of the refrigerant compressed in the compressor 5, and the indoor heat exchangers 4*a*, 4*b* function as evaporators of the refrigerant condensed in the outdoor heat exchanger 3. In addition, during the heating operation, the four-way switching valve 6 connects the discharge side of the compressor 5 and the gas refrigerant connection piping 12 and connects the suction side of the compressor 5 and the gas side of the outdoor heat exchanger 3 (refer to the broken lines of the four-way switching valve 6 in FIG. 1). Accordingly, during the heating operation, the indoor heat exchangers 4*a*, 4*b* function as condensers of the refrigerant compressed in the compressor 5, and the outdoor heat exchanger 3 functions as an evaporator of the refrigerant condensed in the indoor heat exchangers 4*a*, 4*b*.

The outdoor heat exchanger 3 is a cross fin type fin and tube heat exchanger that comprises a heat transfer pipe and a plurality of fins; during the cooling operation, the outdoor heat exchanger 3 functions as a condenser of the refrigerant; during the heating operation, the outdoor heat exchanger 3 functions as an evaporator of the refrigerant. The gas side of the outdoor heat exchanger 3 is connected to the four-way switching valve 6, and the liquid side of the outdoor heat exchanger 3 is connected to the outdoor expansion valve 8.

In addition, the outdoor unit 1 comprises an outdoor fan 7, which sucks the outdoor air into the outdoor unit 1, supplies it to the outdoor heat exchanger 3, and then discharges it to the outdoor space. The outdoor fan 7 is capable of varying the flow volume of the air supplied to the outdoor heat exchanger 3; in the present embodiment, the outdoor fan 7 is a propeller fan that is driven by a motor, which consists of a DC fan motor.

The outdoor expansion valve 8 is a motor operated expansion valve for, for example, regulating the flow volume of the refrigerant that flows inside the outdoor side refrigerant piping 13 and is connected to the liquid side of the outdoor heat exchanger 3.

The refrigerant adjustment unit 20 is a vertical cylinder and, as discussed above, is connected to the main refrigerant circuit 30 via the bypass piping 18*b*. The refrigerant adjustment unit 20 is capable of pooling the refrigerant that flows through the main refrigerant circuit 30 to the refrigerant adjustment vessel 21 of the refrigerant adjustment unit 20. Furthermore, the structure of the refrigerant adjustment unit 20 is discussed below.

The liquid side shutoff valve 50 is provided with connection ports for connecting to the liquid refrigerant connection piping 11 and the outdoor unit 1. In addition, the gas side shutoff valve 51 is provided with connection ports for connecting to the gas refrigerant connection piping 12 and the outdoor unit 1. The liquid side shutoff valve 50 is connected to the outdoor expansion valve 8. The gas side shutoff valve 51 is connected to the four-way switching valve 6.

In addition, the outdoor unit 1 is provided with a discharge side temperature sensor 31, an outdoor heat exchanger temperature sensor 32, an expansion valve inlet side temperature sensor 33, and an expansion valve outlet side temperature sensor 34. The discharge side temperature sensor 31 is provided to the discharge side of the compressor 5. The compressor 5 detects a discharge temperature Td. The outdoor heat exchanger temperature sensor 32 is provided to the outdoor heat exchanger 3 and detects the temperature of the refrigerant that flows therein. The expansion valve inlet side temperature sensor 33 is provided to the first outdoor side liquid refrigerant piping 15*b* and detects the temperature of the refrigerant that flows therethrough. The expansion valve outlet side temperature sensor 34 is provided to the second outdoor side liquid refrigerant piping 15*c* and detects the temperature of the refrigerant that flows therethrough. Furthermore, in the present embodiment, the discharge side temperature sensor 31, the outdoor heat exchanger temperature sensor 32, the expansion valve inlet side temperature sensor 33, and the expansion valve outlet side temperature sensor 34 are composed of thermistors.

(Structure of Refrigerant Adjustment Unit)

Figure 2:
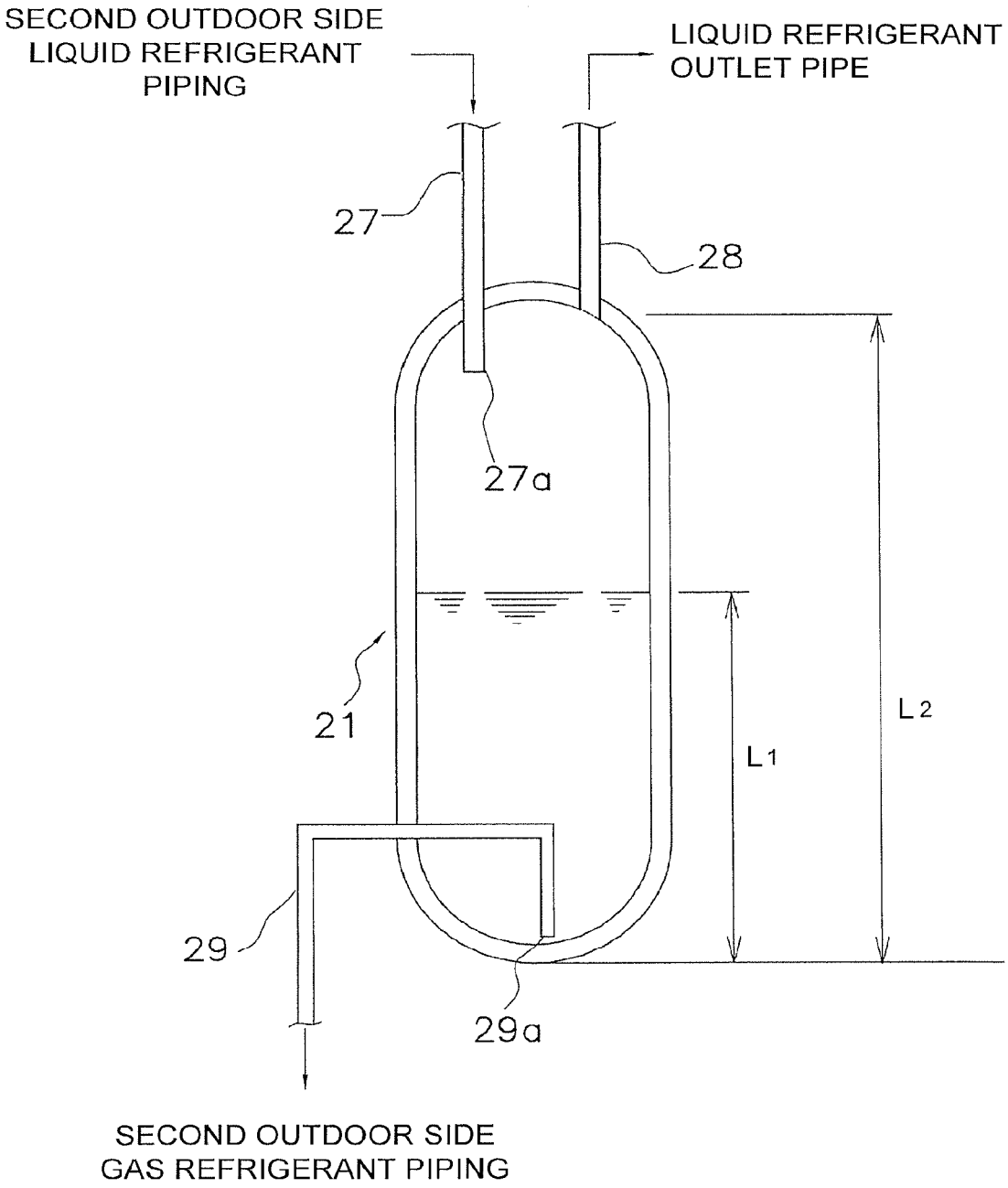
FIG. 2 is a schematic longitudinal cross sectional view of a refrigerant adjustment vessel.

The refrigerant adjustment unit 20 is connected to the main refrigerant circuit 30 via the refrigerant inflow piping 17 and the refrigerant outflow piping 19, which constitute the bypass piping 18*b*, as discussed above. In addition, as shown in FIG. 1 and FIG. 2, the refrigerant adjustment unit 20 principally comprises: the refrigerant adjustment vessel 21, which is capable of pooling the refrigerant; a liquid refrigerant inlet pipe 27, which is part of the refrigerant inflow piping 17; and a liquid refrigerant outlet pipe 29 and an overflow pipe 28, which are parts of the refrigerant outflow piping 19.

The refrigerant adjustment vessel 21 is a vertical cylinder that is capable of pooling a prescribed amount of the refrigerant.

A liquid refrigerant inlet pipe end part 27*a* of the liquid refrigerant inlet pipe 27 has an opening wherethrough the liquid refrigerant that flows through the second outdoor side liquid refrigerant piping 15*c* can flow into the refrigerant adjustment vessel 21. In addition, as shown in FIG. 2, the liquid refrigerant inlet pipe 27 is provided to an upper part of the refrigerant adjustment vessel 21 such that the liquid refrigerant can flow into the refrigerant adjustment vessel 21 from a position that is higher than a position $L_1$ of the liquid surface of the liquid refrigerant pooled in the refrigerant adjustment vessel 21. Furthermore, as shown in FIG. 1, the liquid refrigerant inlet pipe 27 comprises a first solenoid valve 22 and a check valve 23. In the liquid refrigerant inlet pipe 27, the first solenoid valve 22 and the check valve 23 are disposed in series with respect to the flow of the refrigerant. In addition, the check valve 23 is attached such that the refrigerant is only permitted to flow from the second outdoor side liquid refrigerant piping 15*c* toward the refrigerant adjustment vessel 21. Furthermore, the first solenoid valve 22 is provided on the upstream side of the check valve 23.

A liquid refrigerant outlet pipe end part 29*a* of the liquid refrigerant outlet pipe 29 has an opening wherethrough the refrigerant can flow out from a lower part of the refrigerant adjustment vessel 21 to the second outdoor side gas refrigerant piping 16*c*. In addition, as shown in FIG. 2, the liquid refrigerant outlet pipe end part 29*a* of the liquid refrigerant outlet pipe 29 is disposed in the vicinity of a bottom part of the refrigerant adjustment vessel 21. Furthermore, as shown in FIG. 1 the liquid refrigerant outlet pipe 29 comprises a third solenoid valve 25 and a capillary tube 26. The capillary tube 26 reduces the pressure of the refrigerant that flows through the liquid refrigerant outlet pipe 29. Furthermore, in the liquid refrigerant outlet pipe 29, the third solenoid valve 25 is provided on the upstream side of the capillary tube 26.

One end of the overflow pipe 28 is connected to an upper part of the refrigerant adjustment vessel 21, and the other end of the overflow pipe 28 is connected to the liquid refrigerant outlet pipe 29. Consequently, as shown in FIG. 2, the overflow pipe 28 flows the liquid refrigerant out of the refrigerant adjustment vessel 21 only when the position $L_1$ of the liquid surface of the liquid refrigerant pooled inside the refrigerant adjustment vessel 21 reaches a position $L_2$ at the upper part of the refrigerant adjustment vessel 21. In addition, a connecting part between the overflow pipe 28 and the liquid refrigerant outlet pipe 29 is disposed inside the refrigerant adjustment unit 20 and positioned on the downstream side of the capillary tube 26, which is provided to and disposed in the liquid refrigerant outlet pipe 29. Consequently, the overflow pipe 28 can guide the liquid refrigerant from the refrigerant adjustment vessel 21 to the liquid refrigerant outlet pipe 29 only when the position $L_1$ of the liquid surface of the liquid refrigerant pooled inside the refrigerant adjustment vessel 21 reaches the position $L_2$ of the upper part of the refrigerant adjustment vessel 21. In addition, as shown in FIG. 1, the overflow pipe 28 comprises a second solenoid valve 24.

Furthermore, the pipe diameters of the refrigerant pipings adapted to the liquid refrigerant inlet pipe 27, the liquid refrigerant outlet pipe 29, and the overflow pipe 28 are all equal to one another and smaller than the pipe diameter of the refrigerant piping adapted to the main refrigerant circuit 30.

(Control Unit)

Figure 3:
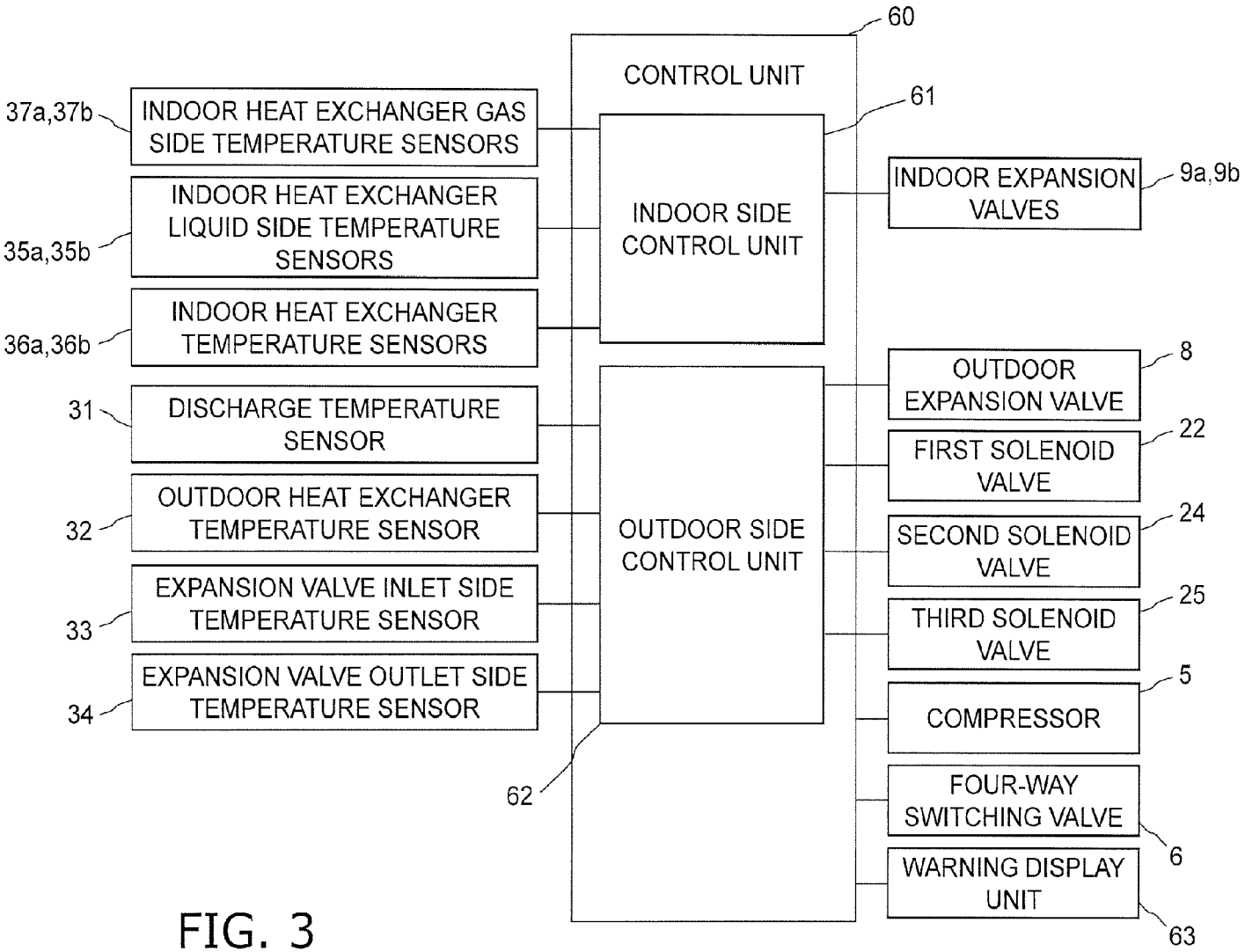
FIG. 3 is a control block diagram of the air conditioner according to the embodiment of the present invention.

As shown in FIG. 3, the air conditioner 100 comprises a control unit 60, which operates and controls each piece of equipment that constitutes the air conditioner 100. The control unit 60 comprises an indoor side control unit 61 and an outdoor side control unit 62 and performs not only normal operations, which include the cooling operation and the heating operation, but also a refrigerant filling operation and a refrigerant amount determining operation.

The indoor side control unit 61 controls the operation of all of the parts that constitute the indoor units 2*a*, 2*b*. The indoor side control unit 61 comprises, for example, a microcomputer, which is provided to control the indoor units 2*a*, 2*b*, and a memory and is capable of exchanging control signals and the like with the remote controls for separately operating the indoor units 2*a*, 2*b*. In addition, the indoor side control unit 61 is connected to the indoor heat exchanger liquid side temperature sensors 35*a*, 35*b*, the indoor heat exchanger gas side temperature sensors 37*a*, 37*b*, and the indoor heat exchanger temperature sensors 36*a*, 36*b*. Consequently, based on the temperatures of the refrigerant detected by the indoor heat exchanger liquid side temperature sensors 35*a*, 35*b*, the indoor heat exchanger gas side temperature sensors 37*a*, 37*b*, and the indoor heat exchanger temperature sensors 36*a*, 36*b*, the indoor side control unit 61 calculates either degrees of overheating when the indoor heat exchangers 4*a*, 4*b* function as evaporators or degrees of supercooling when the indoor heat exchangers 4*a*, 4*b* function as condensers. Furthermore, the indoor side control unit 61 regulates the opening degrees of the indoor expansion valves 9*a*, 9*b* based on the calculated degrees of overheating or degrees of supercooling.

The outdoor side control unit 62 controls the operation of all of the parts that constitute the outdoor unit 1. The outdoor side control unit 62 comprises, for example, a microcomputer, which is provided to control the outdoor unit 1, and an inverter circuit, which controls the memory and the motor, and is capable of exchanging control signals and the like with the indoor side control unit 61. In addition, the outdoor side control unit 62 is connected to the discharge side temperature sensor 31 and the outdoor heat exchanger temperature sensor 32 and performs an overflow determination (discussed below) by controlling the opening and closing of the first solenoid valve 22 and the second solenoid valve 24 based on the temperatures of the refrigerant detected by the discharge side temperature sensor 31 and the outdoor heat exchanger temperature sensor 32. Furthermore, the outdoor side control unit 62 is connected to the expansion valve inlet side temperature sensor 33 and the expansion valve outlet side temperature sensor 34 and performs an overfill determination (discussed below) based on the temperatures of the refrigerant detected by the expansion valve inlet side temperature sensor 33 and the expansion valve outlet side temperature sensor 34.

Furthermore, if a surplus of refrigerant is detected in the main refrigerant circuit 30 during the cooling operation or the heating operation, the outdoor side control unit 62 performs control that switches the first solenoid valve 22 to the open state such that the refrigerant is guided from the main refrigerant circuit 30 to the refrigerant adjustment unit 20. In addition, if an insufficient amount of the refrigerant is detected inside the main refrigerant circuit 30 during the cooling operation or the heating operation, the outdoor side control unit 62 performs control that switches the third solenoid valve 25 to the open state such that the refrigerant is guided from the refrigerant adjustment unit 20 to the main refrigerant circuit 30. Furthermore, an excess or deficient amount of the refrigerant in the main refrigerant circuit 30 is determined based on the degrees of overheating and the degrees of supercooling in the indoor heat exchangers 4*a*, 4*b* calculated by the indoor side control unit 61.

In addition, the control unit 60 performs an operation that switches the cooling operation and the heating operation via the four-way switching valve 6 and controls each piece of equipment, such as the compressor 5 of the outdoor unit 1, in accordance with the operating loads of the indoor units 2*a*, 2*b*. Furthermore, a warning display unit 63, which comprises an LED and the like for reporting that the refrigerant is in the overfilled state in a refrigerant amount determining operation mode (discussed below), is connected to the control unit 60.

<Operation of Air Conditioner>

The following text explains the operation of the air conditioner 100 of the present embodiment.

The operation modes of the air conditioner 100 of the present embodiment include: a normal operation mode, which controls each piece of equipment of the outdoor unit 1 and the indoor units 2*a*, 2*b* in accordance with the operating loads of the indoor units 2*a*, 2*b*; a refrigerant filling operation mode, which is performed after the air conditioner 100 has been installed; and the refrigerant amount determining operation mode, which determines whether the main refrigerant circuit 30 is filled with the appropriate amount of refrigerant. Furthermore, the normal operation mode principally includes the cooling operation and the heating operation.

The following text explains the operation performed in each operation mode of the air conditioner 100.

(Normal Operation Mode)

First, the cooling operation in the normal operation mode will be explained, referencing FIG. 1.

During the cooling operation, the four-way switching valve 6 is in the state indicated by the solid lines in the figure, namely, the state wherein the discharge side of the compressor 5 is connected to the gas side of the outdoor heat exchanger 3, and the suction side of the compressor 5 is connected to the gas side of the indoor heat exchangers 4*a*, 4*b*. In addition, the outdoor expansion valve 8 is set to the open state and the opening degrees of the indoor expansion valves 9*a*, 9*b* are regulated such that the degrees of overheating of the refrigerant on the gas sides of the indoor heat exchangers 4*a*, 4*b* reach prescribed values. Furthermore, in the present embodiment, the degrees of overheating of the refrigerant on the gas sides of the indoor heat exchangers 4*a*, 4*b* are detected by subtracting the refrigerant temperature values detected by the indoor heat exchanger liquid side temperature sensors 35*a*, 35*b* from the refrigerant temperature values detected by the indoor heat exchanger gas side temperature sensors 37*a*, 37*b*. In addition, the first solenoid valve 22, the second solenoid valve 24, and the third solenoid valve 25 are set to the closed state.

If the compressor 5 is activated with the refrigerant circuit 10 in this state, then the low pressure gas refrigerant is sucked into the compressor 5 and compressed and thereby turns into high pressure gas refrigerant. Subsequently, the high pressure gas refrigerant transits the four-way switching valve 6 and is fed to the outdoor heat exchanger 3. The high pressure gas refrigerant fed to the outdoor heat exchanger 3 exchanges heat with the outdoor air supplied by the outdoor fan 7, condenses, and thereby turns into high pressure liquid refrigerant.

Furthermore, the high pressure liquid refrigerant transits the liquid refrigerant connection piping 11 and is fed to the indoor units 2*a*, 2*b*. The pressure of the high pressure liquid refrigerant fed to the indoor units 2*a*, 2*b* is reduced by the indoor expansion valves 9*a*, 9*b*, and thereby the high pressure liquid refrigerant turns into low pressure refrigerant in the vapor-liquid two-phase state, is fed to the indoor heat exchangers 4*a*, 4*b*, exchanges heat with the indoor air via the indoor heat exchangers 4*a*, 4*b*, evaporates, and turns into low pressure gas refrigerant. Here, the indoor expansion valves 9*a*, 9*b* control the amounts of flow of the refrigerant that flows in the indoor heat exchangers 4*a*, 4*b* such that the degrees of overheating on the gas sides of the indoor heat exchangers 4*a*, 4*b* reach prescribed values. This low pressure gas refrigerant transits the gas refrigerant connection piping 12, is fed to the outdoor unit 1, transits the gas side shutoff valve 51 and the four-way switching valve 6, and is once again sucked into the compressor 5.

Furthermore, in accordance with the operating loads of the indoor units 2*a*, 2*b*, there may be a surplus of refrigerant inside the main refrigerant circuit 30 if, for example, the operating load of one of the indoor units 2*a*, 2*b* is small or stopped or if the operating loads of both of the indoor units 2*a*, 2*b* are small. If the outdoor side control unit 62 determines that such a surplus refrigerant state has arisen, then the outdoor side control unit 62 sets the first solenoid valve 22 to the open state. Consequently, some of the refrigerant that flows through the main refrigerant circuit 30 is fed as surplus refrigerant to the refrigerant adjustment vessel 21, wherein it pools temporarily. In addition, a state of insufficient refrigerant may arise in the main refrigerant circuit 30 if, for example, the operating loads of the indoor units 2*a*, 2*b* are large. Thus, if the outdoor side control unit 62 detects an insufficient refrigerant state, then the outdoor side control unit 62 sets the third solenoid valve 25 to the open state. Consequently, the pressure of the liquid refrigerant pooled in the refrigerant adjustment vessel 21 decreases when it passes through the capillary tube 26; that liquid refrigerant then turns into gas refrigerant, merges with the gas refrigerant that flows through the second outdoor side gas refrigerant piping 16*c*, and is sucked into the compressor 5.

The following text explains the heating operation in the normal operation mode.

During the heating operation, the four-way switching valve 6 is in the state indicated by the broken lines in FIG. 1, namely, the state wherein the discharge side of the compressor 5 is connected to the gas side of the indoor side heat exchangers 4*a*, 4*b*, and the suction side of the compressor 5 is connected to the gas side of the outdoor heat exchanger 3. In addition, the outdoor expansion valve 8 is set to the open state and the opening degrees of the indoor expansion valves 9*a*, 9*b* are regulated such that the degrees of supercooling of the refrigerant on the liquid sides of the indoor heat exchangers 4*a*, 4*b* reach prescribed values. Furthermore, in the present embodiment, the degrees of supercooling of the refrigerant on the liquid sides of the indoor heat exchangers 4*a*, 4*b* are detected by subtracting the refrigerant temperatures that the indoor heat exchanger temperature sensors 36*a*, 36*b* detect—that is, the temperatures of the refrigerant that flows inside the indoor heat exchanger 4*a*, 4*b*—from the refrigerant temperature values that the indoor heat exchanger liquid side temperature sensors 35*a*, 35*b* detect. In addition, the first solenoid valve 22, the second solenoid valve 24, and the third solenoid valve 25 are set to the closed state.

If the compressor 5 is activated with the refrigerant circuit 10 in this state, the low-pressure gas refrigerant is sucked into and compressed by the compressor 5, turns into a high-pressure gas refrigerant, and is then fed to the indoor units 2*a*, 2*b* via the four-way switching valve 6 and the gas refrigerant connection piping 12.

Furthermore, the high pressure gas refrigerant fed to the indoor units 2*a*, 2*b* exchanges heat with the indoor air in the indoor heat exchangers 4*a*, 4*b*, is condensed, and turns into high pressure liquid refrigerant, after which its pressure is reduced by the indoor expansion valves 9*a*, 9*b*; thereby, that liquid refrigerant turns into vapor-liquid two-phase low pressure refrigerant. Here, the indoor expansion valves 9*a*, 9*b* control the amounts of flow of the refrigerant that flows inside the indoor heat exchanger 4*a*, 4*b* such that the degrees of supercooling on the liquid sides of the indoor heat exchangers 4*a*, 4*b* reach prescribed values. This low pressure refrigerant in the vapor-liquid two-phase state transits the liquid refrigerant connection piping 11, is fed to the outdoor unit 1, transits the outdoor expansion valve 8, and flows into the outdoor heat exchanger 3. Furthermore, the vapor-liquid two-phase low pressure refrigerant that flows into the outdoor heat exchanger 3 exchanges heat with the outdoor air supplied by the outdoor fan 7, is condensed, turns into low pressure gas refrigerant, transits the four-way switching valve 6, and is once again sucked into the compressor 5.

Furthermore, as is the case during the cooling operation, in accordance with the operating loads of the indoor units 2*a*, 2*b*, the refrigerant, for example, temporarily flows from the main refrigerant circuit 30 into the refrigerant adjustment vessel 21 and pools therein, or flows from the refrigerant adjustment vessel 21 to the main refrigerant circuit 30, thereby supplementing the main refrigerant circuit 30.

Thus, if the normal operation, including the cooling operation and the heating operation, is performed in the air conditioner 100, then amounts of refrigerant flow to the indoor heat exchangers 4*a*, 4*b* in accordance with the operating loads demanded by the air conditioned spaces wherein the indoor units 2*a*, 2*b* are installed.

(Refrigerant Amount Determining Operation Mode)

Next, the refrigerant amount determining operation mode will be explained, referencing FIG. 1. Furthermore, the refrigerant amount determining operation, which is performed in the state wherein the main refrigerant circuit 30 is filled with the refrigerant, determines whether the main refrigerant circuit 30 is filled with the appropriate amount of refrigerant or is overfilled. The present embodiment explains an exemplary case wherein, when the indoor units 2*a*, 2*b* and the outdoor unit 1 are installed onsite and the main refrigerant circuit 30 is manually filled with the refrigerant, it is determined whether the main refrigerant circuit 30 is filled with an appropriate amount of the refrigerant.

Figure 4:
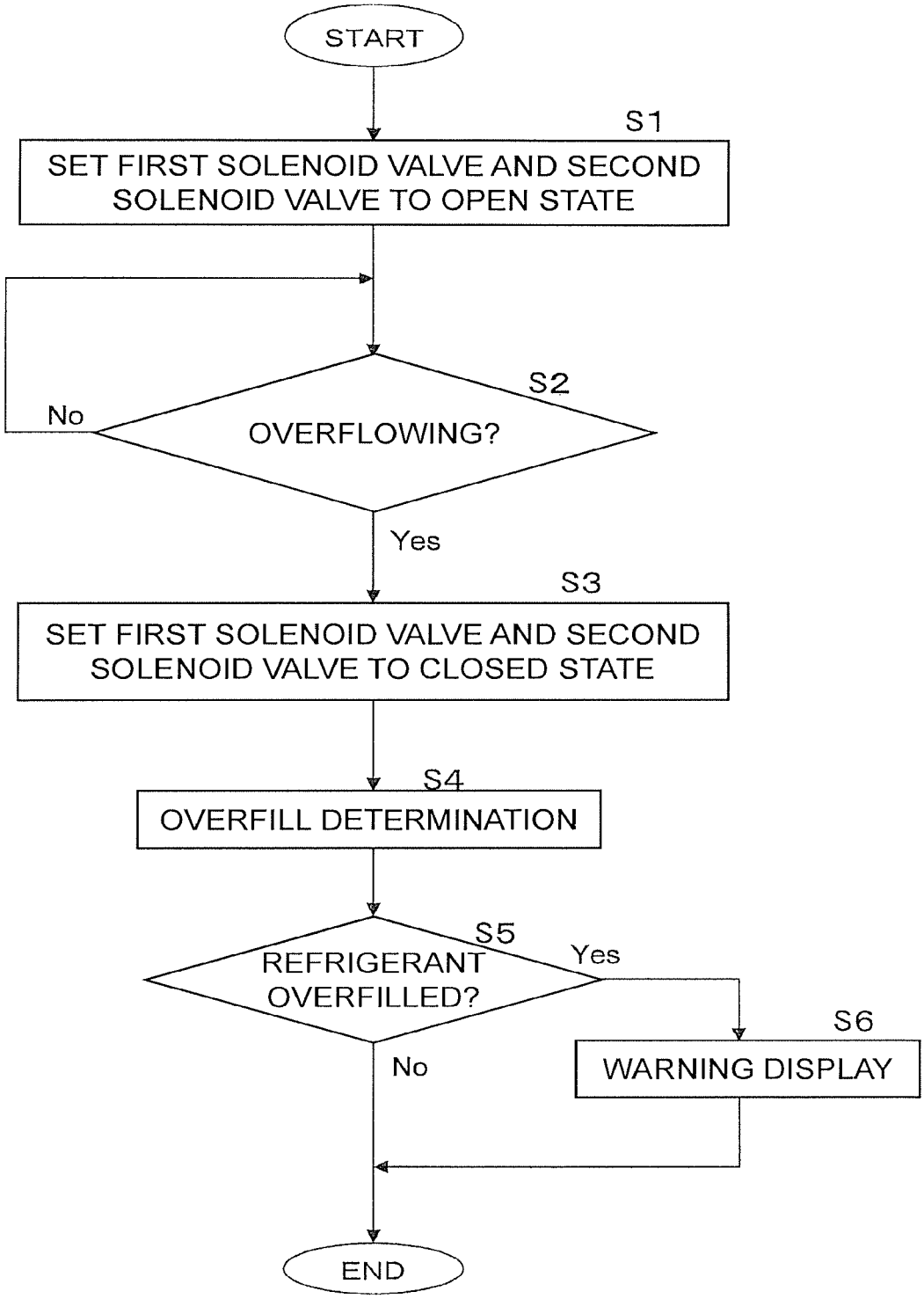
FIG. 4 is a flow chart of a refrigerant amount determining operation in the air conditioner according to the embodiment of the present invention.

After the refrigerant filling operation is complete, the refrigerant amount determining operation (refer to FIG. 4) is performed to determine whether the main refrigerant circuit 30 is filled with the appropriate amount of refrigerant. When a refrigerant amount determining operation start instruction is output, the four-way switching valve 6 in the outdoor unit is set to the state indicated by the solid lines in FIG. 1, the outdoor expansion valve 8 and the indoor expansion valves 9*a*, 9*b* are set to the open state, and the first solenoid valve 22 and the second solenoid valve 24 are set to the open state (i.e., step S1). The compressor 5 is activated with the refrigerant circuit 10 in this state, and thereby the cooling operation is forcibly performed. Consequently, some of the liquid refrigerant filled in the main refrigerant circuit 30 is fed to the refrigerant adjustment vessel 21 via the outdoor side liquid refrigerant piping 15*a*, and thereby this liquid refrigerant pools inside the refrigerant adjustment vessel 21. When the first solenoid valve 22 and the second solenoid valve 24 are set to the open state, it is determined whether the liquid refrigerant that pools inside the refrigerant adjustment vessel 21 is overflowing (i.e., step S2). An overflow of the liquid refrigerant from the refrigerant adjustment vessel 21 occurs when the position $L_1$ of the liquid surface of the liquid refrigerant in the refrigerant adjustment vessel 21 reaches the position $L_2$ of the refrigerant adjustment vessel 21, whereupon the liquid refrigerant flows toward the suction side of the compressor 5 via the overflow pipe 28 and the refrigerant outflow piping 19. If the indoor side control unit 61 determines that there is an overflow from the refrigerant adjustment vessel 21, then the outdoor side control unit 62 sets the first solenoid valve 22 and the second solenoid valve 24 to the closed state (i.e., step S3). Thereby, the liquid refrigerant can no longer flow from the refrigerant adjustment vessel 21 to the second outdoor side gas refrigerant piping 16*c*. Furthermore, the first solenoid valve 22 and the second solenoid valve 24 are set to the open state until the outdoor side control unit 62 detects an overflow.

Furthermore, in the state wherein an overflow has been detected, an overfill determination is made with respect to the amount of refrigerant in the main refrigerant circuit 30 (i.e., step S4). The outdoor side control unit 62 makes an overfill determination with respect to the amount of refrigerant in the main refrigerant circuit 30 based on the state of the refrigerant in the first outdoor side liquid refrigerant piping 15*b* (i.e., step S5). If it is determined that the refrigerant in the first outdoor side liquid refrigerant piping 15*b* is in the vapor-liquid two-phase state, then it is determined that the main refrigerant circuit 30 is not overfilled with the refrigerant, and the refrigerant amount determining operation is complete. In addition, if it is determined that the refrigerant in the first outdoor side liquid refrigerant piping 15*b* is in the liquid phase state, then a warning that reports that the main refrigerant circuit 30 is overfilled with the refrigerant is displayed on a warning display unit (i.e., step S6).

In so doing, it is possible to detect in this air conditioner 100 whether the main refrigerant circuit 30 is overfilled with the refrigerant.

Next, the overflow determination and the overfill determination in the refrigerant amount determining operation will be discussed in detail.

(A) Overflow Determination

The overflow determination is made during the refrigerant amount determining operation. In addition, the overflow determination determines whether the liquid refrigerant is flowing out of the refrigerant adjustment vessel 21 to the suction side of the compressor 5. Furthermore, in the refrigerant amount determining operation, the outdoor heat exchanger 3 functions as a condenser. Consequently, the temperature of the refrigerant detected by the outdoor heat exchanger temperature sensor 32 is designated as the refrigerant condensing temperature.

If the refrigerant in the liquid state is compressed, then a discharge temperature, which is the temperature of the refrigerant discharged from the compressor 5, is lower than the discharge temperature when the refrigerant is in the gas state is compressed. Consequently, the vapor-liquid two-phase refrigerant, which is mixed with liquid refrigerant, is sucked into the compressor 5 and compressed, and therefore the difference between the discharge temperature and the condensing temperature at a prescribed time becomes small. Accordingly, if the position $L_1$ of the liquid surface of the refrigerant in the refrigerant adjustment vessel 21 reaches the position $L_2$ of the upper part of the refrigerant adjustment vessel 21, then the liquid refrigerant flows out of the refrigerant adjustment vessel 21 to the second outdoor side gas refrigerant piping 16*c* via the overflow pipe 28 and the refrigerant outflow piping 19. Furthermore, the liquid refrigerant that flows out merges with the gas refrigerant that flows through the second outdoor side gas refrigerant piping 16*c*, and that liquid refrigerant turns into vapor-liquid two-phase refrigerant. This vapor-liquid two-phase refrigerant is sucked into and compressed by the compressor 5, and therefore the difference between the discharge temperature of the compressor 5 and the condensing temperature at the prescribed time becomes small. Thereby, it is determined that the liquid refrigerant is overflowing from the refrigerant adjustment vessel 21.

(B) Overfill Determination

Like the overflow determination, the overfill determination is made after it is determined that the liquid refrigerant is overflowing from the refrigerant adjustment vessel 21 to the second outdoor side gas refrigerant piping 16*c* during the refrigerant amount determination operation.

The overfill determination determines whether the refrigerant in the first outdoor side liquid refrigerant piping 15*b* is in the vapor-liquid two-phase state or the liquid phase state, and thereby determines whether the main refrigerant circuit 30 is overfilled with the refrigerant.

If the difference between the refrigerant temperature detected by the expansion valve inlet side temperature sensor 33 and the refrigerant temperature detected by the expansion valve outlet side temperature sensor 34 is greater than the prescribed value, then it is determined that the refrigerant flowing through the first outdoor side liquid refrigerant piping 15*b* is in the vapor-liquid two-phase state. In addition, if the difference between the refrigerant temperature detected by the expansion valve inlet side temperature sensor 33 and the refrigerant temperature detected by the expansion valve outlet side temperature sensor 34 is less than the prescribed value, then it is determined that the refrigerant flowing through the first outdoor side liquid refrigerant piping 15*b* is in the liquid phase.

Next, it is determined whether the main refrigerant circuit 30 is overfilled with the refrigerant. As discussed above, this determination is made in the state wherein a prescribed amount of the refrigerant filled in the main refrigerant circuit 30 pools inside the refrigerant adjustment vessel 21. Consequently, if the main refrigerant circuit 30 is filled with an appropriate amount of the refrigerant, then the refrigerant in the main refrigerant circuit 30 is insufficient. Accordingly, if it is determined that the refrigerant flowing through the first outdoor side liquid refrigerant piping 15*b* is in the vapor-liquid two-phase state, then it is determined that the main refrigerant circuit 30 is overfilled with the refrigerant. In addition, if it is determined that the refrigerant flowing through the first outdoor side liquid refrigerant piping 15*b* is in the liquid phase state, then it is determined that the main refrigerant circuit 30 is overfilled with the refrigerant, namely, that the amount of the refrigerant exceeds the appropriate amount.

<Features>

(1)

In the conventional art, among air conditioners that comprise a receiver, the interior of which can pool the refrigerant inside the refrigerant circuit, there exists an air conditioner that is provided with a liquid surface detecting means, which detects the liquid surface of the refrigerant pooled inside the receiver. With regard to this air conditioner, a refrigerant amount determining operation that determines the amount of refrigerant that has been filled in the refrigerant circuit by performing control that maintains the liquid surface inside the receiver at a constant level has been proposed.

In an air conditioner that does not comprise the receiver, it is difficult to determine whether the refrigerant circuit is filled with the appropriate amount of refrigerant. In addition, even in an air conditioner that does comprise the receiver, if the air conditioner does not have a refrigerant amount determining operation function, it is still difficult to determine whether the refrigerant circuit is filled with the appropriate amount of refrigerant.

In contrast, the abovementioned embodiment comprises the refrigerant adjustment vessel 21, the first solenoid valve 22, the second solenoid valve 24, and the outdoor side control unit 62. The outdoor side control unit 62 controls the opening and closing of the first solenoid valve 22 and the second solenoid valve 24. Consequently, the refrigerant that flows through the main refrigerant circuit 30 can be pooled in the refrigerant adjustment vessel 21. In addition, the outdoor side control unit 62 performs the overfill determination by pooling the refrigerant, with which the main refrigerant circuit 30 is filled, in the refrigerant adjustment vessel 21. The overfill determination determines whether the main refrigerant circuit 30 is overfilled with the refrigerant by determining whether the refrigerant in the first outdoor side liquid refrigerant piping 15*b* is in the vapor-liquid two-phase state or the liquid phase state. If the main refrigerant circuit 30 is filled with the appropriate amount of the refrigerant, then the refrigerant with which the main refrigerant circuit 30 is filled pools in the refrigerant adjustment vessel 21, and consequently the refrigerant in the main refrigerant circuit 30 transitions to the insufficient state. Consequently, if the refrigerant flowing through the first outdoor side liquid refrigerant piping 15*b* is in the vapor-liquid two-phase state, then it is determined that the main refrigerant circuit 30 is filled with the appropriate amount of the refrigerant. In addition, if the refrigerant flowing through the first outdoor side liquid refrigerant piping 15*b* is in the liquid phase state, then it is determined that the main refrigerant circuit 30 is overfilled with the refrigerant, namely, that the amount of the refrigerant exceeds the appropriate amount.

Thereby, it is determined that the main refrigerant circuit 30 is overfilled with the refrigerant.

(2)

In the abovementioned embodiment, the diameters of the liquid refrigerant inlet pipe 27 and the overflow pipe 28 are equal to one another and are smaller than the diameters of the pipings that constitute the main refrigerant circuit 30. Consequently, compared with the case wherein, for example, solenoid valves are provided to the main refrigerant circuit 30, smaller solenoid valves can be used for the first solenoid valve 22 and the second solenoid valve 24 provided to the liquid refrigerant inlet pipe 27 and the overflow pipe 28, respectively.

Thereby, in this air conditioner 100, the first solenoid valve 22 and the second solenoid valve 24 cost less than when the solenoid valves are provided to the main refrigerant circuit 30.

(3)

In the abovementioned embodiment, the outdoor side control unit 62 makes an overflow determination. The overflow determination determines whether the liquid refrigerant is flowing out of the refrigerant adjustment vessel 21 to the suction side of the compressor 5. Accordingly, the prescribed amount of the refrigerant with which the main refrigerant circuit 30 is filled can be reliably pooled in the refrigerant adjustment vessel 21. In addition, the overfill determination, which is made by the outdoor side control unit 62, determines whether the prescribed amount of the refrigerant with which the main refrigerant circuit 30 is filled is pooled in the refrigerant adjustment vessel 21.

Consequently, the certainty of the overfill determination is improved compared with the case wherein the overfill determination is performed without performing the overflow determination.

(4)

In the abovementioned embodiment, if a surplus of refrigerant is detected in the main refrigerant circuit 30 during the cooling operation or the heating operation, then the outdoor side control unit 62 sets the first solenoid valve 22 to the open state. Consequently, the refrigerant is guided from the main refrigerant circuit 30 to the refrigerant adjustment unit 20. In addition, if an insufficient amount of the refrigerant is detected in the main refrigerant circuit 30 during the cooling operation or the heating operation, then the outdoor side control unit 62 sets the third solenoid valve 25 to the open state. Consequently, the refrigerant is guided from the refrigerant adjustment unit 20 to the main refrigerant circuit 30.

Thereby, the amount of the refrigerant flowing through the main refrigerant circuit 30 is regulated in accordance with the excess or insufficiency of the refrigerant flowing therethrough.

MODIFIED EXAMPLES

In the abovementioned embodiment, the refrigerant overfill determination is made by detecting the temperature of the refrigerant on the upstream side of the outdoor expansion valve 8 and the temperature of the refrigerant on the downstream side of the outdoor expansion valve 8, and then calculating the difference therebetween. The above notwithstanding, this overfill determination may also be made based on the degree of supercooling on the liquid side of the outdoor heat exchanger 3. Furthermore, the degree of supercooling on the liquid side of the outdoor heat exchanger 3 is calculated by subtracting the temperature of the refrigerant detected by the expansion valve inlet side temperature sensor 33 from the temperature of the refrigerant detected by the outdoor heat exchanger temperature sensor 32. In addition, like the abovementioned embodiment, the overfill determination based on the degree of supercooling is made after it is determined that the liquid refrigerant is overflowing from the refrigerant adjustment vessel 21 to the second outdoor side gas refrigerant piping 16*c*. Accordingly, if the main refrigerant circuit 30 is filled with the appropriate amount of the refrigerant, then this determination is likewise performed in the state wherein the main refrigerant circuit 30 is filled with an insufficient amount of the refrigerant.

If the main refrigerant circuit 30 is filled with the appropriate amount of the refrigerant, then the refrigerant on the liquid side of the outdoor heat exchanger 3 functioning as a condenser has a prescribed degree of supercooling (for example, 3 degree). In addition, if the main refrigerant circuit 30 is filled with an amount of refrigerant that is less than the appropriate amount, then the degree of supercooling becomes less than the prescribed degree of supercooling. If the main refrigerant circuit 30 is filled with the appropriate amount of the refrigerant as discussed above, then this determination is made in the state wherein the main refrigerant circuit 30 is filled with an insufficient amount of the refrigerant. Accordingly, if the calculated degree of supercooling is less than the prescribed degree of supercooling, then it is determined that the main refrigerant circuit 30 is not overfilled with the refrigerant. In addition, if the calculated degree of supercooling is greater than or equal to the prescribed degree of supercooling, then it is determined that the main refrigerant circuit 30 is overfilled with the refrigerant.

Thereby, the overfill determination can be made in the main refrigerant circuit 30.

In addition, determining the amount of refrigerant with which the main refrigerant circuit 30 is filled based on the degree of supercooling eliminates the need for the expansion valve outlet side temperature sensor 34 and makes it possible to reduce cost.

INDUSTRIAL APPLICABILITY

According to the present invention, in an air conditioner that comprises a heat source unit, utilization units, and a refrigerant connection piping that connects the heat source unit and the utilization units, it is possible to determine whether the refrigerant circuit is filled with the appropriate amount of refrigerant.

What is claimed is:

1. An air conditioner, comprising:

a compressor configured to compress a refrigerant;

a first heat exchanger connected to a discharge port of the compressor to function as a condenser;

a high pressure piping extending from the first heat exchanger;

a second heat exchanger connected to the first heat exchanger via the high pressure piping to function as an evaporator;

a low pressure piping connecting the second heat exchanger to a suction port of the compressor;

a pressure reducing mechanism arranged to reduce pressure of refrigerant in the high pressure piping;

a bypass passageway arranged to divert refrigerant from the high pressure piping to the low pressure piping without passing through the second heat exchanger;

a vessel connected to the bypass passageway;

a first opening/closing mechanism arranged to open/close a first portion of the bypass passageway that connects the high pressure piping to the vessel;

a second opening/closing mechanism arranged to open/close a second portion of the bypass passageway that connects an upper part of the vessel to the low pressure piping; and a third opening/closing mechanism arranged to open/close a third portion of the bypass passageway in order to selectively block the refrigerant that flows from the vessel to the low pressure piping through the third portion, the third portion of the bypass passageway connecting a lower part of the vessel and the low pressure piping separately from the second portion and being provided with a bypass pressure reducing mechanism arranged to reduce pressure of refrigerant therein.

2. The air conditioner according to claim 1, wherein the compressor, the first heat exchanger, the high pressure piping, the second heat exchanger, and the low pressure piping constitute parts of a main refrigerant circuit; and a piping with a diameter smaller than the high pressure piping is used for the first and second portions of the bypass passageway.

3. The air conditioner according to claim 2, further comprising:

a control unit configured to perform an overfill determination in order to determine whether the refrigerant is in an excessively filled state; wherein the control unit controls the overfill determination by performing:

a first step, which sets each of the first opening/closing mechanism and the second opening/closing mechanism to an open state;

a second step, which detects when liquid refrigerant has started to flow from the vessel to the low pressure piping;

a third step, which sets at least the second opening/closing mechanism to a closed state in accordance with the start of flow of the liquid refrigerant to the low pressure piping being detected in the second step; and a fourth step, upon detection of the start of flow of the liquid refrigerant to the low pressure piping in the second step, which determines whether an amount of the refrigerant in the main refrigerant circuit is in an insufficient range or in a sufficient range and thereby determines whether the refrigerant is in the excessively filled state.

4. The air conditioner according to claim 3, wherein in the fourth step, the control unit determines whether the refrigerant at an outlet of the first heat exchanger is in a vapor-liquid two-phase or a liquid phase in order to determine whether the amount of the refrigerant in the main refrigerant circuit is in the insufficient range or the sufficient range.

5. The air conditioner according to claim 4, further comprising:

a first temperature sensor arranged to detect temperature of the refrigerant on an upstream side of the pressure reducing mechanism; and a second temperature sensor arranged to detect temperature of the refrigerant on a downstream side of the pressure reducing mechanism; wherein in the fourth step, the control unit calculates a difference between the temperature detected by the first temperature sensor and the temperature detected by the second temperature sensor, and the control unit determines that the refrigerant at the outlet of the first heat exchanger is in the liquid phase and that there is an overfilled state if the difference is less than or equal to a first threshold value, and the control unit determines that the refrigerant at the outlet of the first heat exchanger is in the vapor-liquid two-phase state and that there is not an overfilled state if the difference is greater than the first threshold value.

6. The air conditioner according to claim 5, wherein in the second step, the control unit is configured to monitor a difference between a discharge refrigerant temperature of the compressor and a condensing temperature of the first heat exchanger, determine a degree of descent per unit of time of the difference between the discharge refrigerant temperature of the compressor and the condensing temperature of the first heat exchanger, and determine that the liquid refrigerant has begun to flow from the vessel to the low pressure piping through the second portion of the bypass passageway when the degree of descent per unit of time of the difference is greater than a third threshold value.

7. The air conditioner according to claim 4, wherein in the second step, the control unit is configured to monitor a difference between a discharge refrigerant temperature of the compressor and a condensing temperature of the first heat exchanger, determine a degree of descent per unit of time of the difference between the discharge refrigerant temperature of the compressor and the condensing temperature of the first heat exchanger, and determine that the liquid refrigerant has begun to flow from the vessel to the low pressure piping through the second portion of the bypass passageway when the degree of descent per unit of time of the difference is greater than a third threshold value.

8. The air conditioner according to claim 3, wherein in the fourth step, the control unit determines whether a degree of supercooling of the refrigerant at the outlet of the first heat exchanger is less than or equal to a second threshold value or greater than the second threshold value.

9. The air conditioner according to claim 8, wherein in the second step, the control unit is configured to monitor a difference between a discharge refrigerant temperature of the compressor and a condensing temperature of the first heat exchanger, determine a degree of descent per unit of time of the difference between the discharge refrigerant temperature of the compressor and the condensing temperature of the first heat exchanger, and determine that the liquid refrigerant has begun to flow from the vessel to the low pressure piping through the second portion of the bypass passageway when the degree of descent per unit of time of the difference is greater than a third threshold value.

10. The air conditioner according to claim 3, wherein in the second step, the control unit is configured to monitor a difference between a discharge refrigerant temperature of the compressor and a condensing temperature of the first heat exchanger, determine a degree of descent per unit of time of the difference between the discharge refrigerant temperature of the compressor and the condensing temperature of the first heat exchanger, and determine that the liquid refrigerant has begun to flow from the vessel to the low pressure piping through the second portion of the bypass passageway when the degree of descent per unit of time of the difference is greater than a third threshold value.

11. The air conditioner according to claim 1, further comprising:

a control unit configured to perform refrigerant adjustment control in a normal operation of the air conditioner; wherein the compressor, the first heat exchanger, the high pressure piping, the second heat exchanger, and the low pressure piping constitute parts of a main refrigerant circuit; and when refrigerant adjustment control is performed, the control unit sets each of the first and second opening/closing mechanisms to an open state and sets the third opening/closing mechanism to a closed state when it is determined that an excessive amount of the refrigerant is flowing through the main refrigerant circuit, and the control unit sets each of the first and second opening/closing mechanisms to the closed state and sets the third opening/closing mechanism to the open state when it is determined that an insufficient amount of the refrigerant is flowing through the main refrigerant circuit.

12. The air conditioner according claim 1, wherein the third portion of the bypass passageway is connected to the vessel at a position lower than the second portion.

* * * * *